US008534173B2

(12) United States Patent
Holliday

(10) Patent No.: US 8,534,173 B2
(45) Date of Patent: Sep. 17, 2013

(54) PAPER PUSHING DEVICE

(75) Inventor: Brightman Kenneth Holliday, Conyers, GA (US)

(73) Assignee: Atlas Die LLC, Elkhart, IN (US)

( * ) Notice: Subject to any disclaimer, the term of this patent is extended or adjusted under 35 U.S.C. 154(b) by 207 days.

(21) Appl. No.: 12/827,620

(22) Filed: Jun. 30, 2010

(65) Prior Publication Data

US 2012/0001137 A1 Jan. 5, 2012

(51) Int. Cl.
*B26D 7/06* (2006.01)

(52) U.S. Cl.
USPC ..... 83/109; 83/437.1; 83/437.2; 24/458; 254/1

(58) Field of Classification Search
USPC ..... 101/408, 412; 24/67.9, 67.11, 458, 24/545, 297, 453, 563; 248/71; 83/719, 83/722, 723, 435.15, 436.2, 437.1, 437.2, 83/27
See application file for complete search history.

(56) References Cited

U.S. PATENT DOCUMENTS

| | | | | | |
|---|---|---|---|---|---|
| 377,620 | A * | 2/1888 | Jones | 254/40 |
| 744,538 | A * | 11/1903 | Halvorson | 101/412 |
| 1,519,944 | A * | 12/1924 | Warsen August W | 101/412 |
| 1,603,223 | A * | 10/1926 | Villeneuve | 101/408 |
| 2,242,478 | A * | 5/1941 | Pekarz | 24/457 |
| 2,575,172 | A * | 11/1951 | Isella | 101/412 |
| 3,494,244 | A * | 2/1970 | Wayland | 411/510 |
| 3,707,226 | A * | 12/1972 | Wippermann | 206/490 |
| 3,881,676 | A * | 5/1975 | Reinwall | 248/224.8 |
| 4,850,950 | A | 7/1989 | Holliday | |
| 5,029,505 | A | 7/1991 | Holliday | |
| 5,140,872 | A | 8/1992 | Holliday et al. | |
| 5,197,367 | A | 3/1993 | Holliday | |
| 5,211,084 | A | 5/1993 | Holliday et al. | |
| 5,333,519 | A | 8/1994 | Holliday et al. | |
| 5,582,102 | A | 12/1996 | Holliday | |
| RE35,522 | E | 6/1997 | Holliday | |
| 5,730,039 | A | 3/1998 | Holliday et al. | |
| 6,644,153 | B1 * | 11/2003 | Gordon | 83/27 |
| 6,659,927 | B2 | 12/2003 | Myers et al. | |
| 6,692,425 | B2 | 2/2004 | Myers et al. | |
| 6,779,426 | B1 | 8/2004 | Holliday | |
| 6,792,840 | B2 | 9/2004 | Myers et al. | |
| 7,111,534 | B1 * | 9/2006 | Simpson | 83/27 |
| 7,185,376 | B2 * | 3/2007 | Brown | 4/633 |
| 8,061,247 | B2 * | 11/2011 | Coursey et al. | 83/109 |
| 8,166,858 | B2 * | 5/2012 | Luquette | 83/115 |
| 8,266,993 | B2 * | 9/2012 | Coursey et al. | 83/109 |
| 2007/0066125 | A1 * | 3/2007 | Uenver et al. | 439/459 |
| 2007/0082541 | A1 * | 4/2007 | Alloway et al. | 439/492 |
| 2010/0037741 | A1 * | 2/2010 | Luquette | 83/115 |

* cited by examiner

*Primary Examiner* — Joseph J Hail
*Assistant Examiner* — Joel Crandall
(74) *Attorney, Agent, or Firm* — Kilyk & Bowersox, P.L.L.C.

(57) ABSTRACT

According to various embodiments, the present teachings relate to a paper pushing device. The paper pushing device can include a shaft configured to be received and anchored in an opening of a substrate, for example, a retaining board. The paper pushing device can include a base that extends from the shaft, and a paddle connected to the base at a shoulder. The base can extend in a first direction perpendicular to the shaft and away from the central axis of the shaft, and the paddle can extend in a second direction opposite the first direction and past the central axis of the shaft. Methods are also provided whereby the paper pushing device can be used in various die-cutting and workpiece manipulating operations.

15 Claims, 3 Drawing Sheets

PAPER PUSHING DEVICE

FIELD

The present teachings relate to the field of paperboard processing, and more particularly to a device, system, and method for pushing paperboard, or other sheet-like stock out of a press, die, punch, stripping station, blanking station, or other paperboard manipulating apparatus.

BACKGROUND

Packaging, stationary, and other paper-based products are generally manufactured using sheets of paperboard or other raw paper stock that is drawn across a press, die, punch, stripping station, blanking station, or other paperboard manipulating equipment. Cartons, containers, playing cards, signs, placards, corrugated boxes, and other paperboard products are generally formed by contacting the stock with a punch or die. The methods can comprise contacting the stock with a cutting or creasing blade to generate blanks out of the sheet.

A first process of stripping out holes or sections from a larger piece of stock is generally referred to as stripping. Stripping leaves a shaped hole and a desired perimeter or outline in the otherwise intact stock paperboard. Subsequently, a second process of cutting or punching a desired shape or section of the stock entirely out of the stock, dropping, and collecting the removed portion, is generally referred to as blanking. In both stripping and blanking operations, the paperboard, cardboard, plastic, fibrous, or other material, is conveyed over a working area. The working area can generally include a flat cutting surface or a hollow female blanking area over which a blank piece of stock can be contacted with a blade, punch, or other working tool. The paperboard or stock is conveyed through such work stations on support frames, for example, on wooden, metal, paddled, or other support frames, which can be sized to conform to the size of the blank stock. The sheets can be conveyed across the stripping or blanking stations using conveyor belts, belt drives, linear motors, or other sources of mechanical driving force.

Known stripping and blanking configurations suffer from a number of drawbacks. During a stripping operation, a paperboard stock is cut and/or creased into a desired form. The cut stock can be perforated such that the desired product remains attached to the surrounding paperboard skeleton. During a stripping operation, the paperboard stock can become stuck or lodged in the die as the die is retracted from the work station. Also, during a stripping operation, the surrounding paperboard skeleton can become stuck in the stripper.

Similarly, during blanking operations, a blanking press can cause pressure on a paperboard stock such that a desired product can be removed from the surrounding paperboard skeleton. When the blanking press is retracted from the work station, a vacuum can be created between the blanking press and the product blank, thereby causing the paperboard skeleton product to become stuck in the blanking unit. Resulting jams and hang-ups in the material supply path and incomplete or faulty stripping and/or blanking operations can require valuable operator time and effort to fix. These errors can also cause lost costs due to manufacturing downtime, and can result in a loss of potentially recoverable material. A need exists to eliminate these and other drawbacks in the art.

SUMMARY

In some embodiments, the present teachings relate to a paper pushing device that comprises a shaft configured to be received in an opening of a retaining board. The shaft can comprise a central axis, a distal end, and a support end opposite the distal end.

According to various embodiments, in addition to the shaft, the paper pushing device can comprise a base, a shoulder extending upward from the base, and a paddle connected to the shoulder. In some embodiments, the base, shoulder, and paddle can be considered part of an arm and the device can comprise the arm connected to the shaft.

The base can have opposing first and second ends. The first end can intersect with the support end of the shaft at an intersection. The base can comprise a first thickness. The base can extend in a first direction perpendicular to the shaft and away from the central axis of the shaft. The paddle can extend in a second direction opposite the first direction and extend past the central axis of the shaft.

According to various embodiments, the paddle can comprise a lower first section and an elevated second section. The elevated second section can extend upwardly from the lower first section at an angle of from about 110° to about 160°. The paddle can comprise a second thickness that is greater than the first thickness of the base.

According to various embodiments, the shaft can comprise a diameter that is at least half the width of the base. The shaft can comprise one or more splines protruding from an outer surface of the shaft to secure the shaft in the retaining board. The shaft can comprise one or more annular sections in addition to or instead of the one or more splines. In some embodiments, the shaft can comprise a plurality of annular sections, wherein the annular sections are spaced apart from one another. Each annular section can extend radially outwardly from the shaft and can comprise an outer diameter that is greater than the minimum diameter of the shaft.

In some embodiments, the present teachings relate to a system comprising a paper pushing device as described herein and a retaining board that can comprise an operational surface. The retaining board can comprise an opening disposed in the operational surface, for example, a hole, a recess, a well, a through hole, or the like. The shaft of the paper pushing device can be disposed in the opening, for example, to anchor the device in the retaining board. The retaining board can comprise a thickness, and in some embodiments the opening can comprise at least one through hole that extends all the way through the thickness of the retaining board. In some embodiments, the opening can comprise a hole that does not extend all the way through the retaining board such that the opening comprises a bottom. The opening can have a diameter that matches the outer diameter of the shaft, or that is just slightly larger than the outer diameter of the shaft such that the shaft snugly fits within the opening. If the shaft is provided with annular sections the opening can have a diameter that is the same as or only slightly larger than the outer diameter of the annular sections.

According to various embodiments, the retaining board can comprise one or more die rule slots disposed in the operational surface. The die rule slots can be configured to receive a die rule. The retaining board can comprise one or more die lock retaining slots disposed in the operational surface. The die lock retaining slots can intersect with one or more die rule slots. The die lock retaining slots can be configured to receive a die lock. One or more die locks disposed in one or more respective die lock retaining slots can be used to lock one or more die rules in the one or more die rule retaining slots. For example, die rules, die locks, retaining boards, adjustment systems, and methods that can be used according to various embodiments include those shown and described in U.S. Pat. Nos. 6,779,426; 5,730,039; RE 35,522; 5,582,102; 5,333, 519; 5,211,084; 5,197,367; 5,140,872; 5,029,505; and 4,850,950; each of which is incorporated herein in its entirety by reference.

In some embodiments, the present teachings relate to a method of processing a workpiece. The method can comprise manipulating a workpiece in at least one station. The at least one station can comprise a die cutting station, a rotary die cutting station, a burst cutting station, a stripping station, a blanking station, an embossing station, a printing station, or the like. The station can be used to form a manipulated workpiece, for example, a manipulated paperboard blank. The method can comprise expelling the workpiece from the at least one station by using a paper pushing device according to the present teachings. The paper pushing device can comprise a shaft configured to be received in the opening of a retaining board and the paper pushing device can comprise an arm connected to the shaft. The paper pushing device can comprise an arm extending from the shaft. The arm can comprise a planar base connected to the shaft and extending in a first direction, a shoulder extending upwardly from the planar base, and a paddle connected to the shoulder and extending in a second direction that is opposite the first direction. The workpiece can comprise any type of material that can be manipulated by a stripping station, a blanking station, an embossing station, a printing station or the like, for example, the workpiece can comprise a paperboard stock.

These and other embodiments of the present teachings will be more fully understood with reference to the drawings appended hereto and the detailed description set forth below. The specific embodiments described herein are exemplary only and are not to be construed as limiting. Various modifications, substitutions, deletions, and other changes can be made, as would be understood by those skilled in the art, without departing from the present teachings.

DRAWINGS

The present teachings will be described with reference to the accompanying drawings, in which like elements are referenced with like numbers.

DETAILED DESCRIPTION

Figure 2:
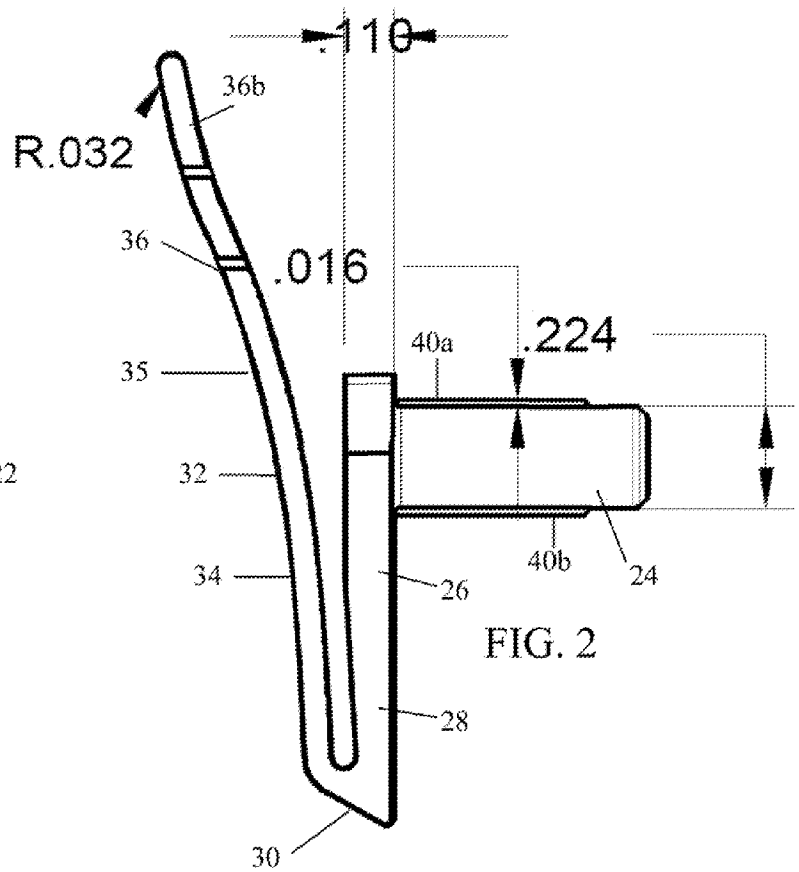
FIG. 2 is a side view of the paper pushing device shown in FIG. 1.
Figure 1:
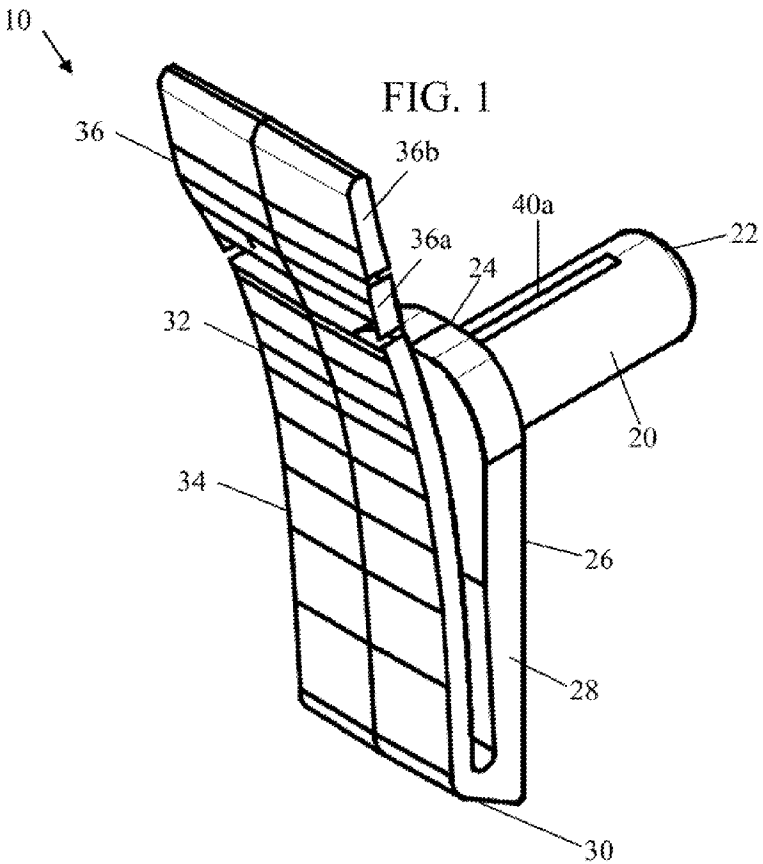
FIG. 1 is a side perspective view of a paper pushing device according to various embodiments of the present teachings.

According to various embodiments of the present teachings, a paper pushing device is provided that can be configured to contact paperboard or other stock, for example, that comprises fibrous material, paper, plastic, film, a web, or cardboard. In some embodiments, the stock can comprise any product capable of being manipulated by a die cutting press. The paper pushing device can comprise a shaft that can be configured to be received and anchored in an opening in a retaining board, for example, as described in U.S. patent application Ser. No. 12/426,699, which is incorporated herein in its entirety by reference. The shaft can have a central axis. The paper pushing device can comprise an arm connected to the shaft. The arm can comprise a base, a shoulder extending upward from the base, and a paddle connected to the shoulder. The base can comprise opposing first and second ends. The first end of the base can connect and intersect with the support end of the shaft at an intersection. The base can be planar and comprise a first thickness. The base can extend in a first direction perpendicular to the shaft and away from the central axis of the shaft. The shoulder can extend upwardly from the second end of the base and connect to the paddle. The paddle can extend in a second direction opposite the first direction and past the central axis of the shaft. The paddle can comprise a lower first section and an elevated second section, the elevated second section can extend upwardly from the lower first section and can be angled with respect to the lower first section at an angle of from about 110° to about 160° relative to the lower first section, for example, at an angle of from about 120° to about 150°, or from about 125° to about 145°, or from about 130° to about 140°. The paddle can comprise an upper contact surface and a lower undersurface. The upper contact surface of the paddle can contact a workpiece. The paddle can have a width that widens as it approaches a distal edge.

According to various embodiments, the paper pushing device can be used in combination with a retaining board to form a system or station. The station can comprise, for example, a die cutting station, a rotary die cutting station, a burst cutting station, a blanking station, a stripping station, an embossing station, a printing station, a creasing station, a bending station, a shaving station, a trimming station, and/or any other station used in the tool and die industry. In a preferred embodiment, the station is a die cutting station.

According to various embodiments, a workpiece, such as a piece of paperboard stock, can be manipulated by a work station. The workpiece can comprise one or more sheets of paper, paperboard material, web, film, net, fibrous material, or the like, that can be manipulated by the work station. As the workpiece is manipulated by the work station, the paper pushing device of the present teachings can be used to prevent problems such as catching, snagging, and lodging of the stock, blank, skeleton, and/or waste. Although referred to as a paper pushing device, it is to be understood that the device, system, and method of the present teachings can apply to the manipulation of other materials than paper.

According to various embodiments, the paper pushing device of the present teachings can comprise a resilient and/or elastic material such that when a pressure is applied to the paper pushing device, the device can be configured to be elastically deformed. When the pressure is removed, the device can elastically rebound to its original position. An example of materials that can be used to form the paper pushing device can include, but are not limited to, polymeric materials, polyethylene (PE), polyurethane (PU), polypropylene (PP), cyclic polyolefin materials, polyoxymethylene (POM), polytetrafluoroethylene (PTFE), other plastic materials, aluminum, stainless steel, titanium, combinations thereof, and/or any other suitable material that provides elasticity. The paper pushing device can comprise acetal resin, for example, DELRIN® acetal resin, available E.I. du Pont de Nemours and Company, Wilmington, Del.

In some embodiments, the paper pushing device can be configured such that when a force is applied to the contact surface, the paddle can compress due to the force. The paddle can be configured, however, to elastically rebound in response to retraction of the applied force. The elasticity of the paper pushing device can allow for the paddle to return, rebound, and/or recoil to an original position, repeatedly. In some embodiments, the contact surface of the paddle can contact a workpiece, causing the paddle to become compressed. The paddle can be configured to elastically rebound so as to apply sufficient pressure to a resulting manipulated workpiece to push the workpiece out of the station and/or clear it from die rules, creasing rules, perforating rules, or other manipulating devices in the station. The paper pushing device can be configured to push a workpiece and thereby separate the workpiece, from surrounding scrap. For example, the paper pushing device can be configured to push a work product out of a manipulating station and away from scrap material, for example, out of a die cutting station.

According to various embodiments, the shaft can comprise a first diameter. The base can have a width that is greater than the first diameter of the shaft. The retaining board can comprise an operational surface. The operational surface can comprise an opening for receiving the paper pushing device. The opening in the retaining board can be wide enough to allow the shaft to be inserted therein but to be snugly fit therein. The opening of the retaining board can be narrow enough so as to prevent the arm from being inserted into the opening. In some embodiments, the retaining board can comprise a plurality of openings, each for receiving a respective paper pushing device. Each opening can extend all the way through the retaining board, but in some embodiments, the opening does not extend all the way through the board and instead has a bottom surface. In some embodiments, the end of the shaft can be configured to contact the bottom surface of the opening.

According to various embodiments, the operational surface of the retaining board can comprise one or more openings for receiving any number of tool and/or die components. Each opening can comprise, for example, a slot, a gap; a groove, a recess, a hole, a through-hole, or another type of opening. The openings can be configured so as to receive, hold, anchor, and/or lock in place any number of tool and die components. For example, the retaining board can comprise openings to receive, hold, anchor, and/or lock in place dies, compressible cushioning devices, paper pushing devices, paper lifting devices and/or any other tool and die components. The retaining board can comprise any known board material, for example, metal, wood, plastic, composite, a combination thereof, or the like.

According to various embodiments, the paper pushing device of the present teachings can be configured to push paper away from a die rule that is disposed in a retaining board or other substrate. In some embodiments, the paper pushing device of the present teachings can be configured to push a workpiece out of a vacuum hold. The paper pushing device can be configured to press against a workpiece such that the workpiece is prevented from getting stuck to components mounted in or on a retaining board. In some embodiments, the paper pushing device can be used in a stripping station or a blanking station. The paper pushing device can be configured to be disposed in an interference area of a male stripper device to prevent scrap material from lifting up after stripping has occurred.

With reference to the drawings, a paper pushing device 10, according to various embodiments of the present teachings, can comprise a shaft 20. Shaft 20 can have a first diameter. The diameter of shaft 20 can be from about 0.01 inch to about 2.00 inches, for example, from 0.10 inch to 1.00 inch, or from about 0.20 inch to 0.50 inch, or about 0.224 inch. As will be appreciated, the diameter of shaft 20 of the paper pusher 10 is not limited to a specific range of values, and cross-sectional shapes other than circular shapes can be used. Shaft 20 can comprise a distal end 22 and a support end 24 opposite the distal end. In some embodiments, shaft 20 can be of the same diameter from distal end 22 to support end 24. Shaft 20 can comprise a central axis that runs parallel to the length of shaft 20.

According to various embodiments and as illustrated in FIGS. 1-5, paper pushing device 10 can comprise an arm 26 that intersects with support end 24 of shaft 20. Arm 26 can extend at an angle relative to support end 24 of shaft 20. Arm 26 can extend at an angle that is in a range of from 88° to 98°, from 89° to 96°, from 90° to 95°, or at about 90°. Arm 26 can have any suitable dimensions. For example, arm 26 can have a length of about 0.5 to about 3.0 inches, from about 1.0 to about 2.0 inches, or of about 1.5 inches, about 1.6 inches, about 1.7 inches, or about 1.8 inches. In some embodiments, the length of arm 26 is about 1.697 inches. According to various embodiments, the exact angle at which arm 26 extends from shaft 20, is not necessarily limited to a specific range of values.

In some embodiments, arm 26 can comprise a base 28, a shoulder 30, and a paddle 32. A first end of base 28 can connect to support end 24 of shaft 20, and a second end of base 28 can connect to shoulder 30. The thickness, length, and width of base 28 are not limited to the specific dimensions described herein.

As will be appreciated, arm 26 does not need to comprise each of these parts. In some embodiments, one or more of the above mentioned parts for arm 26 can be removed, replaced or combined.

According to various embodiments, paddle 32 can comprise a lower first section 34 and an elevated second section 36. The elevated second section 36 can extend upwardly from lower first section 34. Elevated second section 36 can be angled with respect to lower first section 34 at an angle of from about 110° to about 160°, for example, from about 115° to 150°, from 120° to 130°, or at about 120°. Elevated second section 36 of paddle 32 can have a divergent intermediate section **36*a* and an end section 36*b* that extends from divergent intermediate section 36*a*. As shown more clearly in FIG. 2, and section 36*b* can comprise a rounded distal edge. The rounded edge of end section 36*b*** can have any suitable radius of curvature. According to some embodiments the radius of curvature of the rounded edge can be from about 0.01 inch to about 0.06 inch, or from about 0.02 inch to about 0.05 inch, or about 0.032 inch.

As shown in FIG. 2, the thickness of base 28 can remain the same. The thickness of base 28 can be from about 0.05 inch to about 1.5 inches, from 0.1 inch to 1.0 inch, or from about 0.2 inch to about 0.8 inch. The thickness of base 28 can be about, for example, 0.110 inch. Base 28, however, is not limited to this design. Base 28 can instead be designed according to various embodiments to have a first thickness that is narrower at the first end, and a second thickness that is wider at the second end, or vice versa. The thickness of paddle 32 can be less than the thickness of base 28. The thickness of paddle 32 can be from about 0.05 inch to about 0.10 inch, from about 0.06 inch to about 0.9 inch, or from about 0.07 inch to about 0.08 inch. Paddle 32 can instead be designed according to various embodiments to have a first thickness that is narrower at a first end, and a second thickness that is thicker at a second end.

According to various embodiments and as illustrated in FIG. 2, arm 26 can extend away from shaft 20 at an angle with respect to support end 24 of shaft 20. As shown in FIG. 2, arm 26 can extend from support end 24 of shaft 20 at an angle of approximately 90°. As will be appreciated, the angle at which arm 26 extends from support end 24 is not limited to a specific angle and can be within any of a number of ranges of angles, for example, the angle can be within the range of from 90° to 100°. As shown in FIG. 2, shoulder 30 can intersect with base 28 of arm 26 at an angle of about 30° to about 80°, or from 40° to 60°, or from 45° to 50°. Paddle 32 can extend from shoulder 30 at an angle of about 30° to about 80°, from about 40° to about 70°, from about 50° to about 60°, or of about 55°. As will be appreciated, the angle with which paddle 32 extends from shoulder 30 and shoulder 30 extends from base 28 is not limited to a specific angle and can be within any appropriate range of angles.

According to various embodiments and as illustrated in FIG. 2, paddle 32 can comprise a contact surface 35. Contact surface 35 can be configured to contact a workpiece. In some embodiments, contact surface 35 can be generally planar. Contact surface 35 is not limited to a planar design, and can be of any shape desired.

Figure 3:
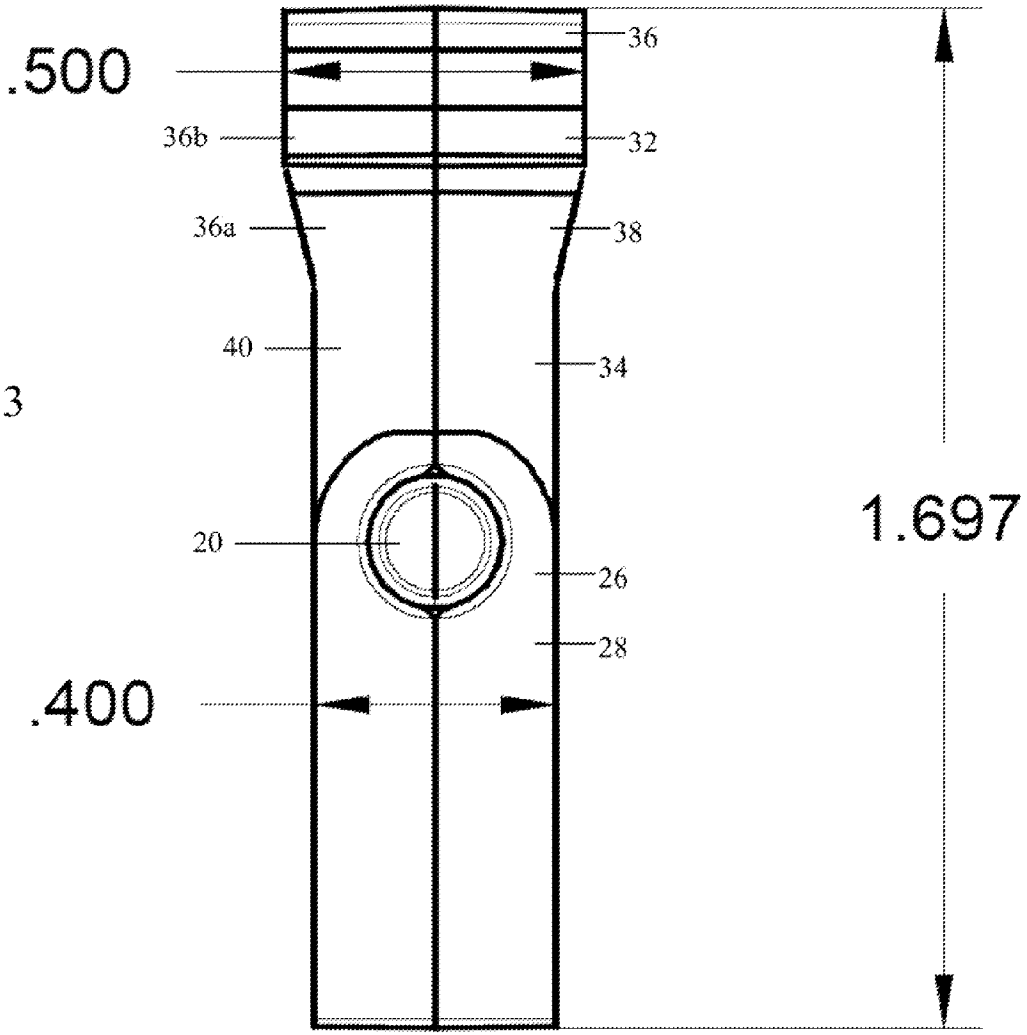
FIG. 3 is a bottom view of the paper pushing device shown in FIG. 1.

FIG. 3 shows a bottom view of the paper pushing device 10, in which an undersurface 40 of paddle 32 can be seen. As shown in FIG. 3, lower first section 34 of paddle 32 can be generally rectangular shaped. It will be appreciated, however, that the shape of paddle 32 is not limited to this design. In some embodiments, paddle 32 can be rectangular, trapezoidal, oval, elliptical, triangular, or of any other shape. Elevated second section 36 of paddle 32 can have a width that is greater than the width of lower first section 34 of paddle 32. Lower first section 34 of paddle 32 can comprise a width of from about 0.2 inch to about 0.6 inch, for example, from 0.25 inch to 0.5 inch, about 0.3 inch, about 0.4 inch, or about 0.5 inch. The width of lower first section 34 of paddle 32 can remain the same. Upper second section 36 can have a width that is narrower at least at a portion of intermediate divergent section 36*a*, and wider at end section 36*b*. Upper second section 36 of paddle 32 can comprise a width of from about 0.4 inch to about 0.8 inch, for example, from 0.4 inch to 0.6 inch, about 0.4 inch, about 0.5 inch, or about 0.6 inch. As is shown, the width of base 28 can be the same as lower first section 34.

Figure 4:
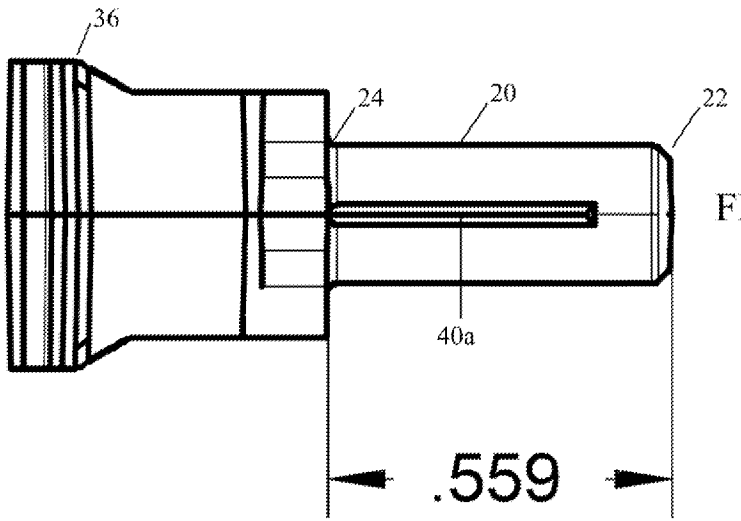
FIG. 4 is front view of the paper pushing device shown in FIG. 1.
Figure 5:
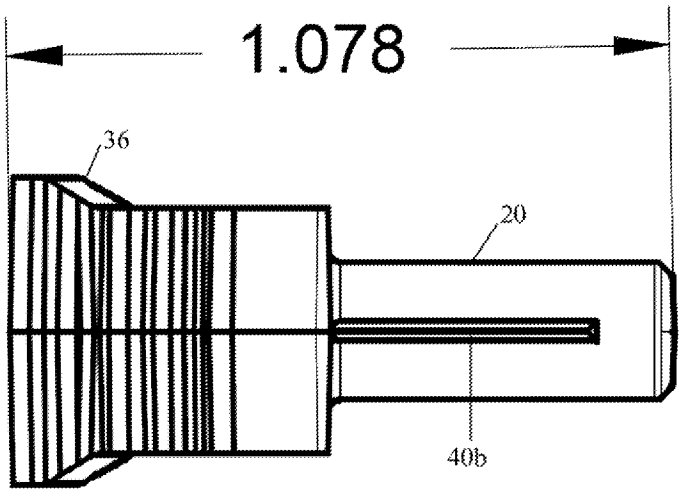
FIG. 5 is an end view of the paper pushing device shown in FIG. 1.

According to various embodiments, and as shown in FIGS. 4 and 5, paper pushing device 10 can comprise one or more splines 40*a* and 40*b*, protruding from an outer surface of shaft 20. Splines 40*a* and 40*b* can extend substantially along the length of shaft 20 between support end 24 and distal end 22 of shaft 20. Splines 40*a* and 40*b* can be arranged at opposite sides of shaft 20. Splines 40*a* and 40*b* can further secure shaft 20 in a retaining board. Splines 40*a* and 40*b* can protrude about 0.01 to about 0.05 inch from the outer surface of shaft 20. In some embodiments, splines 40*a* and 40*b* protrude about 0.016 inch above the outer surface of shaft 20.

Although not shown in the FIGS., paper pushing device 10 can comprise one or more annular protrusions extending away from shaft 20, for example, as described in U.S. patent application Ser. No. 12/426,699, which incorporated herein in its entirety by reference. Each annular protrusion can comprise a diameter that is greater than the diameter of shaft 20. Each annular protrusion can extend perpendicularly relative to the longitudinal axis of shaft 20. In some embodiments, shaft 20 does not comprise any annular protrusions.

According to various embodiments, the paper pushing device of the present teachings can be implemented in a system. The system can comprise a substrate, for example, a retaining board, and one or more paper pushing devices mounted in the substrate. The substrate can comprise an operational surface that can be configured to receive, hold, anchor, secure, and/or lock in place any number of components for use in die cutting, rotary cutting, burst cutting, stripping, blanking, cutting, embossing, printing, or other workpiece manipulation activities. An example of a retaining board that can be used is as described in U.S. patent application Ser. No. 12/426,699, which is incorporated herein in its entirety by reference.

According to various embodiments, the paper pushing device of the present teachings can be used in a stock manipulation method. The method can comprise processing a workpiece, for example, in at least one manipulation station. The at least one station can comprise at least one of a stripping station, a blanking station, an embossing station, a printing station, a combination thereof, or any other tool and die station. The method can comprise manipulating a stock to form a manipulated workpiece.

According to various embodiments, the method can comprise expelling a workpiece from the at least one station with a paper pushing device. The paper pushing device can comprise any of the features listed previously, for example, a shaft configured to be received in an opening of a retaining board, an arm extending away from the shaft and comprising a base, a paddle, and a shoulder disposed between the base and the paddle. The expelling can comprise bending the paddle with an applied force and subsequently pushing the workpiece with the paddle.

Other embodiments will be apparent to those skilled in the art from consideration of the present specification and practice of various embodiments disclosed herein. It is intended that the present specification and examples be considered as exemplary only.

What is claimed is:

1. A paper pushing device comprising:

a shaft configured to be received in an opening of a substrate, the shaft comprising a central axis, a distal end, a support end opposite the distal end, and at least one spline extending from an outer surface of the shaft to secure the shaft in a retaining board;

a base that intersects with the support end of the shaft at an intersection and extends in a first direction perpendicular to the shaft and away from the central axis of the shaft, the base having a first thickness;

a shoulder that extends upwardly away from the base; and a paddle connected to the shoulder that extends in a second direction, opposite the first direction, and past the central axis of the shaft, the paddle having a second thickness that is less than the first thickness;

wherein the paddle comprises a lower first section that intersects with the shoulder, and an elevated second section that intersects with the lower first section, the elevated second section extending upwardly from the lower first section, being angled with respect to the lower first section, and comprising a divergent intermediate section and a distal end section, wherein the width of the distal end section is greater than at least a portion of the divergent intermediate section.

2. The paper pushing device of claim 1, wherein the lower first section is angled with respect to the elevated second section at an angle of from about 110° to about 160°.

3. The paper pushing device of claim 1, wherein the shoulder is angled with respect to the base at an angle of from about 40° to about 70°.

4. The paper pushing device of claim 1, wherein the paper pushing device comprises an elastic material.

5. The paper pushing device of claim 1, wherein the paper pushing device comprises an acetal resin.

6. A system comprising:

the paper pushing device of claim 1; and a substrate comprising an operational surface and an opening disposed in the operational surface, wherein the shaft of the paper pushing device is disposed in the opening.

7. The system of claim 6, wherein the substrate has a thickness and the opening comprises at least one through hole that extends all the way through the thickness of the retaining board.

8. The system of claim 6, wherein the opening comprises a bottom and does not extend all the way through the retaining board.

9. A method of processing a workpiece, comprising:

manipulating a workpiece in at least one station comprising at least one of a die cutting station, a rotary die cutting station, a burst cutting station, a stripping station, a blanking station, an embossing station, and a printing station, to form a manipulated workpiece; and expelling the workpiece from the at least one station with a paper pushing device, the paper pushing device comprising:

a shaft configured to be received in an opening of a substrate, the shaft comprising a central axis, a distal end, a support end opposite the distal end, and at least one spline extending from an outer surface of the shaft to secure the shaft in a retaining board;

a base that intersects with the support end of the shaft at an intersection and extends in a first direction perpendicular to the shaft and away from the central axis of the shaft;

a shoulder that extends upwardly away from the base; and a paddle connected to the shoulder that extends in a second direction, opposite the first direction, and past the central axis of the shaft;

wherein the paddle comprises a lower first section that intersects with the shoulder, and an elevated second section that intersects with the lower first section, the elevated second section extending upwardly from the lower first section, being angled with respect to the lower first section, and comprising a divergent intermediate section and a distal end section wherein the width of the distal end section is greater than at least a portion of the divergent intermediate section.

10. The method of claim 9, wherein the manipulating comprises performing a die cutting operation.

11. The method of claim 9, wherein the manipulating comprises performing a rotary die cutting operation.

12. The method of claim 9, wherein the expelling comprises bending the paddle with the workpiece and subsequently pushing the workpiece with the paddle.

13. The method of claim 9, wherein the workpiece comprises a paperboard.

14. A paper pushing device comprising:

a shaft configured to be received in an opening of a substrate, the shaft comprising a central axis, a distal end, a support end opposite the distal end, and at least one spline extending from an outer surface of the shaft to secure the shaft in a retaining board;

a base that intersects with the support end of the shaft at an intersection and extends in a first direction perpendicular to the shaft and away from the central axis of the shaft;

a shoulder that extends upwardly away from the base; and a paddle connected to the shoulder that extends in a second direction, opposite the first direction, and past the central axis of the shaft;

wherein the paper pushing device comprises an acetal resin, the paddle comprises a lower first section that intersects with the shoulder, the paddle comprises an elevated second section that intersects with the lower first section, the elevated second section extends upwardly from the lower first section and is angled with respect to the lower first section, the elevated second section comprises a divergent intermediate section and a distal end section, and the width of the distal end section is greater than at least a portion of the divergent intermediate section.

15. A system comprising a paper pushing device and a retaining board, the paper pushing device comprises:

a shaft configured to be received in an opening of a substrate, the shaft comprising a central axis, a distal end, a support end opposite the distal end, and at least one spline extending from an outer surface of the shaft to secure the shaft in the retaining board, a base that intersects with the support end of the shaft at an intersection and extends in a first direction perpendicular to the shaft and away from the central axis of the shaft, a shoulder that extends upwardly away from the base, and a paddle connected to the shoulder that extends in a second direction, opposite the first direction, and past the central axis of the shaft, wherein the paddle comprises a lower first section that intersects with the shoulder, and an elevated second section that intersects with the lower first section, the elevated second section extending upwardly from the lower first section, being angled with respect to the lower first section, and comprising a divergent intermediate section and a distal end section, wherein the width of the distal end section is greater than at least a portion of the divergent intermediate section; and the retaining board has a thickness, comprises an operational surface, and comprises an opening disposed in the operational surface, wherein the opening comprises at least one through hole that extends all the way through the thickness of the retaining board, and the shaft of the paper pushing device is disposed in the opening.

* * * * *